US007467748B2

(12) United States Patent
Weaver et al.

(10) Patent No.: US 7,467,748 B2
(45) Date of Patent: Dec. 23, 2008

(54) SYSTEM, METHOD, AND APPARATUS FOR RAILROAD GUIDE RAIL SUPPORT

(75) Inventors: Brian Weaver, Burlington, KY (US); Robert C. Roberts, Jr., Talladega, AL (US); Mark Sutcliffe, Newport, KY (US)

(73) Assignee: Progress Rail Services Corp., Albertville, AL (US)

( * ) Notice: Subject to any disclaimer, the term of this patent is extended or adjusted under 35 U.S.C. 154(b) by 617 days.

(21) Appl. No.: 11/243,765

(22) Filed: Oct. 5, 2005

(65) Prior Publication Data

US 2007/0074639 A1 Apr. 5, 2007

(51) Int. Cl.
*E01B 5/00* (2006.01)

(52) U.S. Cl. ..... 238/17; 238/310; 238/338; 238/357

(58) Field of Classification Search ..... 246/441, 246/445; 238/17, 18, 19, 20, 21, 22, 23, 238/379, 310, 316, 338, 336, 343, 348, 349, 238/351, 355, 357; 104/242
See application file for complete search history.

(56) References Cited

U.S. PATENT DOCUMENTS

| | | | | |
|---|---|---|---|---|
| 1,463,943 | A * | 8/1923 | Fallon | 238/20 |
| 2,929,562 | A * | 3/1960 | Hosbein | 238/379 |
| 4,265,401 | A * | 5/1981 | Jackson | 238/17 |
| 5,148,980 | A * | 9/1992 | Fritz et al. | 238/17 |
| 5,176,318 | A * | 1/1993 | Young et al. | 238/17 |
| 6,279,833 | B1 * | 8/2001 | Schwiede | 238/17 |

* cited by examiner

*Primary Examiner*—Mark T Le
(74) *Attorney, Agent, or Firm*—Bracewell & Giuliani LLP

(57) ABSTRACT

A guide rail support assembly includes a brace and a guide rail positioned on the brace. A hook device having a base and two hooks extending from the base and around the brace and secures the guide rail to the brace. The brace has no apertures such that the hooks extend completely around the brace without penetrating any portion of the brace. Adjustment shims are positioned adjacent the brace and a spring clip is mounted adjacent the base and the adjustment shims for securing the hook device to the brace.

18 Claims, 9 Drawing Sheets

SYSTEM, METHOD, AND APPARATUS FOR RAILROAD GUIDE RAIL SUPPORT

BACKGROUND OF THE INVENTION

1. Technical Field

The present invention relates in general to railroad guide rails and, in particular, to an improved system, method, and apparatus for supporting a railroad guide rail.

2. Description of the Related Art

A guide or guard rail aligns the wheels on railroad cars to prevent damage to track components. Guide rails also force the wheels to follow a desired path where the wheels may derail. Guide rails are located in railroad tracks adjacent the high side of curves, across bridges, adjacent turnout frogs, and at elevated sections of track. At turnout frogs, guide rails divert the path of one wheel of a railroad car to cause the opposite wheel to be drawn away from the turnout frog. Otherwise, a wheel may strike the frog and cause undesired wear or damage to the frog.

Some guide rails are not adjustable and are replaced when the guide rail face has worn such that it no longer properly guides the path of the non-guarded wheels. Some guide rails are formed from track rail that is parallel to the guarded running rail. Installation of the heavy track rail was difficult and somewhat imprecise. In many instances, the guide rail assembly is mounted on the same tie plates as that of the traffic rail, thus linking the installation points of the guide rail to the tie spacing. Other guide rails are fastened to the traffic rail. Such fastening often requires drilling of the running rail, which makes installation difficult.

Still other guide rails are formed from rolled steel. The guide bars are mounted on a bracket or brace and provide a guide face parallel to the gage line of a running rail. The guard bars and the support brackets or braces are separate items, and only the guard bar is replaced when the guard face wears beyond an acceptable limit. Again, some guide rail assemblies do not have an adjustment to compensate for the wear of the guard face. However, some recent designs provide an adjustment to compensate for wear of the guard face.

Most guide rail assemblies are secured to tie plates for traffic rails or directly to the traffic rails themselves by threaded fasteners or by welding. Threaded fasteners require a high level of maintenance due to their tendency to loosen over a period of time. Those guide rail assemblies that are affixed to the running rail and require drilling of the running rail are time consuming and difficult to install and maintain. Thus, an improved guide rail support system that overcomes the problems associated with the prior art would be desirable.

SUMMARY OF THE INVENTION

One embodiment of a system, method, and apparatus for a guide rail support assembly comprises a brace and a guide rail positioned on the brace. The guide rail extends in a longitudinal direction. A hook device has a base and two or more hooks extending from the base perpendicular to the guide rail. The hooks extend around the brace and secure the guide rail to the brace. The brace has no apertures, such that the hooks extend completely around the brace without penetrating any portion of the brace. Adjustment shims are positioned adjacent the brace. A spring clip is mounted adjacent the base and the adjustment shims for securing the hook device to the brace.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
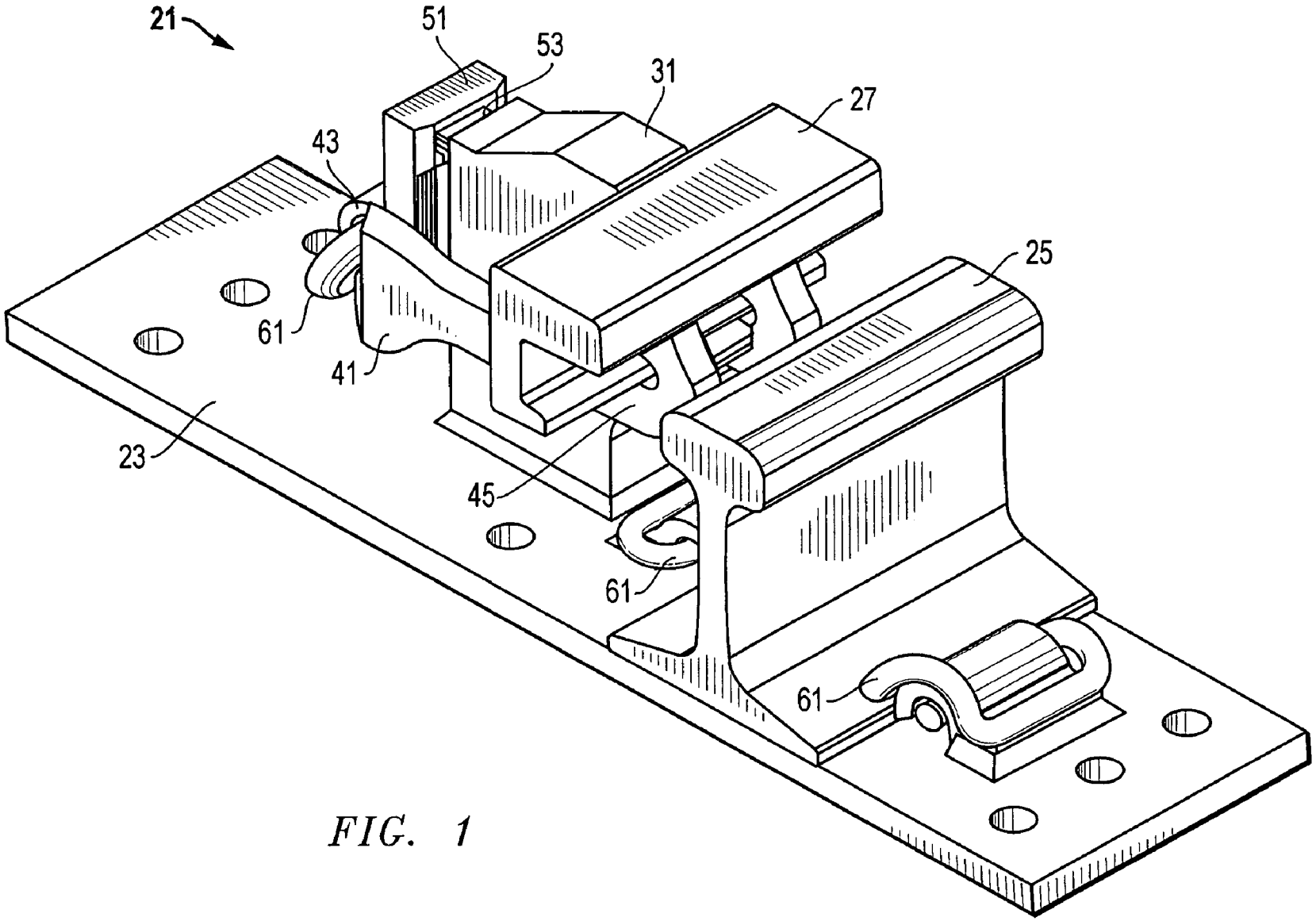
FIG. 1 is an isometric view of one embodiment of a guard rail support assembly constructed in accordance with the present invention.
Figure 2:
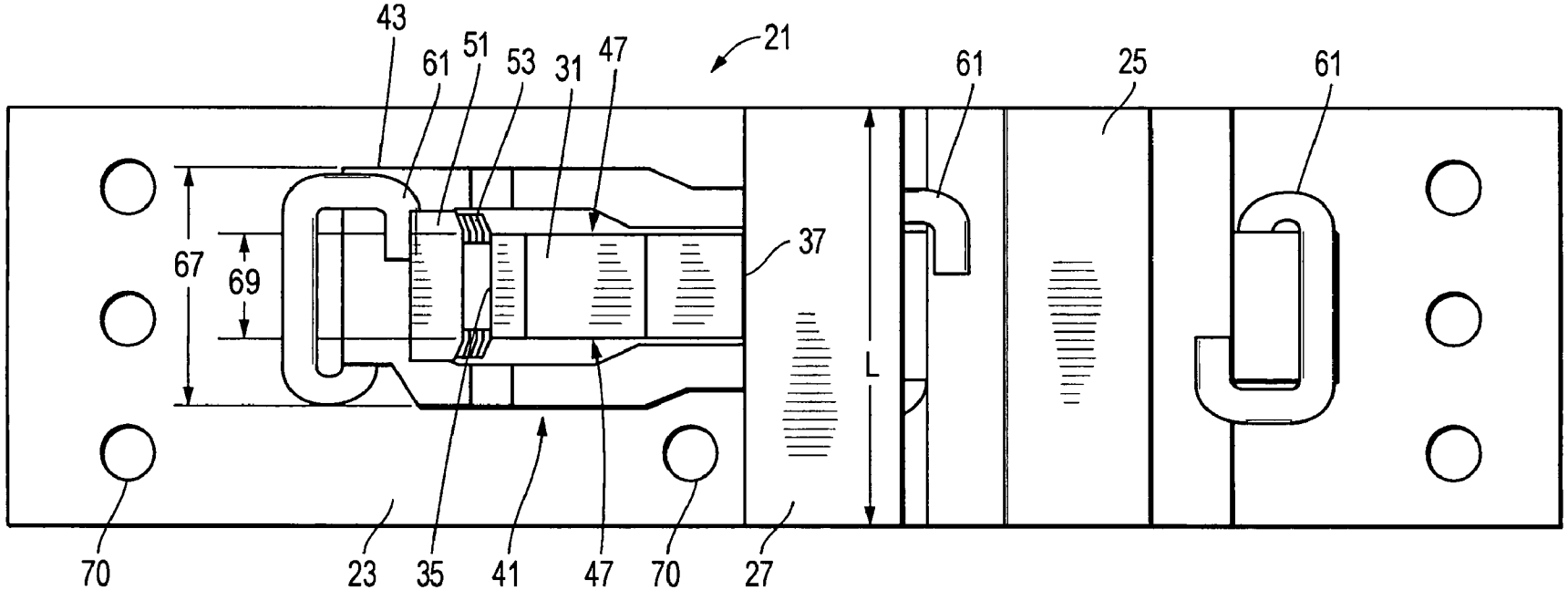
FIG. 2 is a top view of the assembly of FIG. 1 and is constructed in accordance with the present invention.
Figure 7:
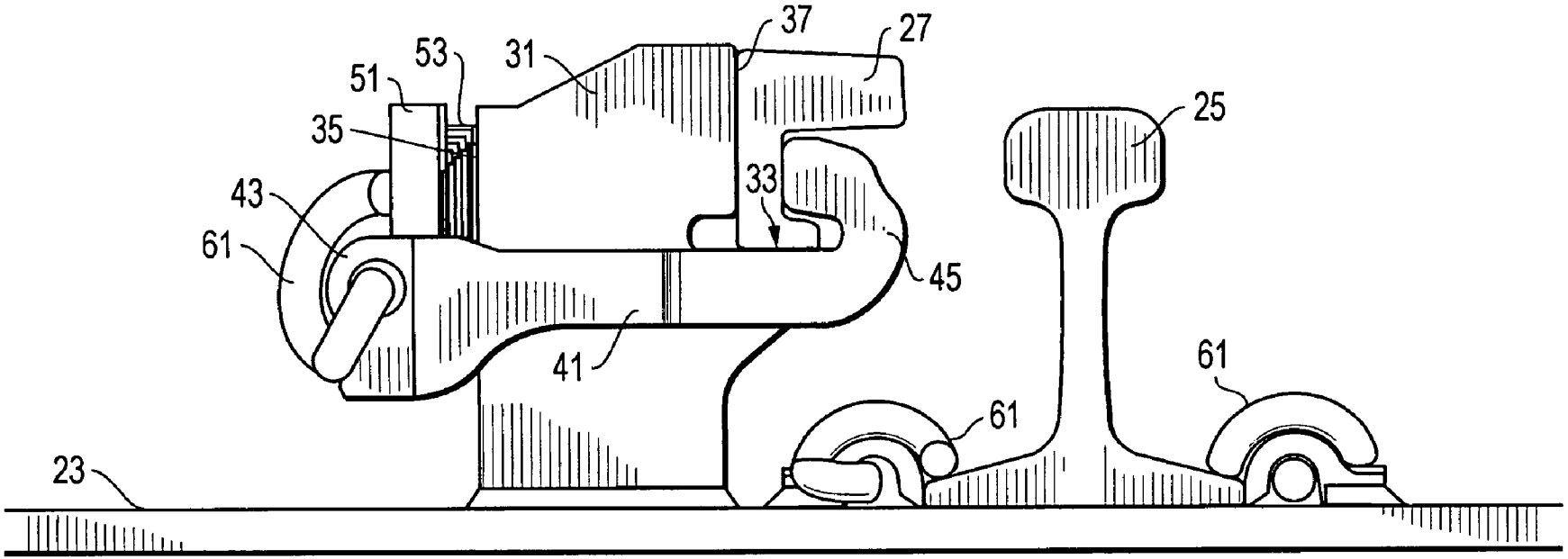
FIG. 7 is a side view of the assembly of FIG. 1 shown at a final stage of assembly after FIG. 6.

Referring to FIGS. 1, 2, and 7, one embodiment of a guide rail support assembly 21 constructed in accordance with the present invention is shown. Typically, assembly 21 is mounted to a tie plate 23, which also supports a main rail 25. The railroad section in which assembly 21 is located naturally comprises numerous plates 23 (one shown) and a pair or main rails 25 (one shown) mounted to the plates 23. The guide bar 27 that is supported by assembly 21 typically requires numerous assemblies 21, which are mounted to the plates 23 adjacent one of the main rails 25.

The illustrated guide rail support assembly 21 comprises a brace 31 that is directly mounted (e.g., welded) to plate 23. The brace 31 has a horizontal front ledge 33 and a vertical rear wall 35 that is opposite the front ledge 33. In the embodiment shown, the vertical rear wall 35 has no horizontal ledge extending therefrom, unlike prior art designs. Moreover, the brace 31 has no apertures in this embodiment. The guide bar 27 is positioned on the front ledge 33 of the brace 31 against a vertical front wall 37. The guide bar 27 has a longitudinal length "L" that defines a longitudinal direction.

The assembly 21 also includes a hook device 41 having, in one embodiment, a tubular base 43 and a plurality of hooks 45 (e.g., two) extending from the tubular base 43. The hooks 45 extend completely around the lateral sides 47 (FIG. 2) of the brace 31, and do not penetrate any portion of the brace 31 to secure the guide bar 27 to the brace 31. A spacer block 51 is positioned between the base 43 and the brace 31. One or more adjustment shims 53 having one or more thicknesses are positioned adjacent to the base 43 between the spacer block 51 and the rear wall 35 of the brace 31. Shims 53 also may be initially positioned between the guide rail 27 and the front wall 37 of the brace 31 (FIG. 8), depending on the application. The spacer block 51 has one or more lips that land on one or more shelves adjacent base 43. Shims 53 have L-shaped portions that land in a cavity in spacer block 51 to prevent vertical movement. The shims 53 are secured from lateral movement by brace 31, and from longitudinal movement by their bent wings (FIG. 2). A conventional spring clip 61, such as a Pandrol clip, is mounted to the base 43 and engages the spacer block 51 for securing the hook device 41 to the brace 31.

In one embodiment, the base 43 of the hook device 41 comprises a horizontal tubular base extending in the longitudinal direction for receiving a straight end of the spring clip 61. The hook device 41, including the horizontal tubular base 43, has a longitudinal width 67 (FIG. 2) that is greater than a longitudinal width 69 of the brace 31. In this version, the longitudinal width 69 of the brace 31 is reduced such that the brace 31 provides clearance for the optional installation of at least two screw spikes 70 (FIG. 2) in the plate 23 underlying the brace 31.

Figure 9:
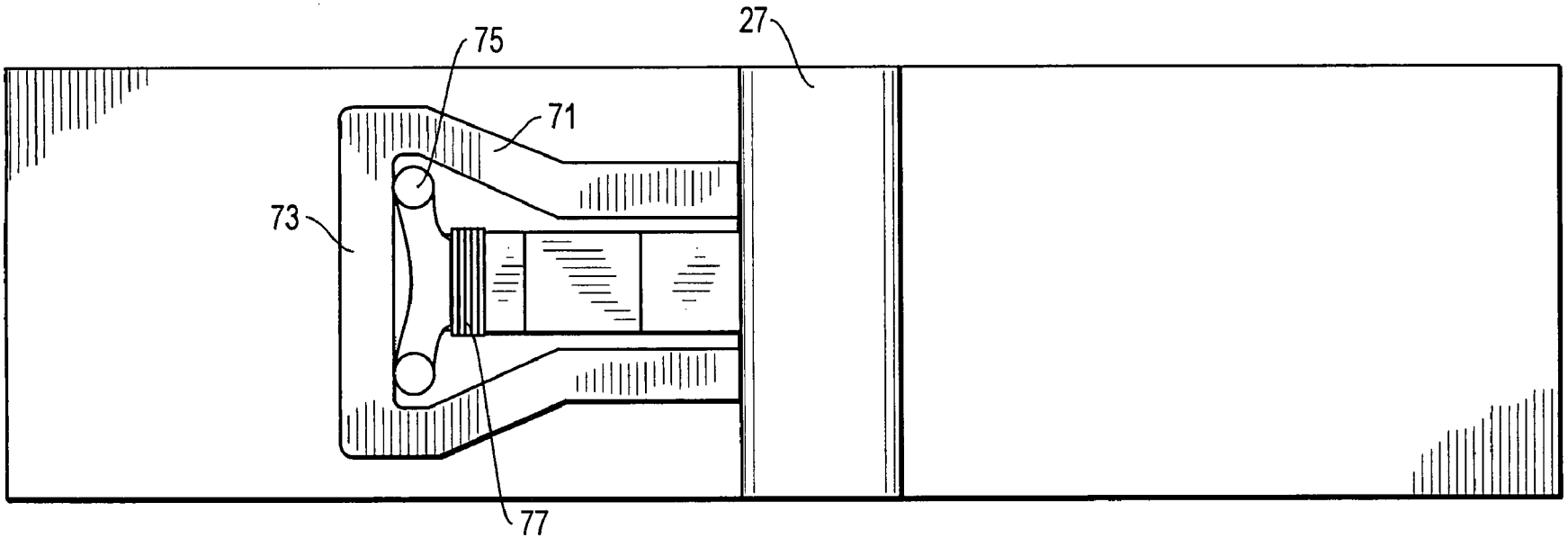
FIG. 9 is a top view of an alternate embodiment of a guard rail support assembly constructed in accordance with the present invention.

In an alternate embodiment (FIG. 9), an alternate design for a hook device 71 is used comprising a flat vertical wall base 73, rather than a tubular shaped base. In this version, the spring clip is a flat compression spring 75 that is located directly between the base 73 and the adjustment shims 77 as shown.

Figure 3:
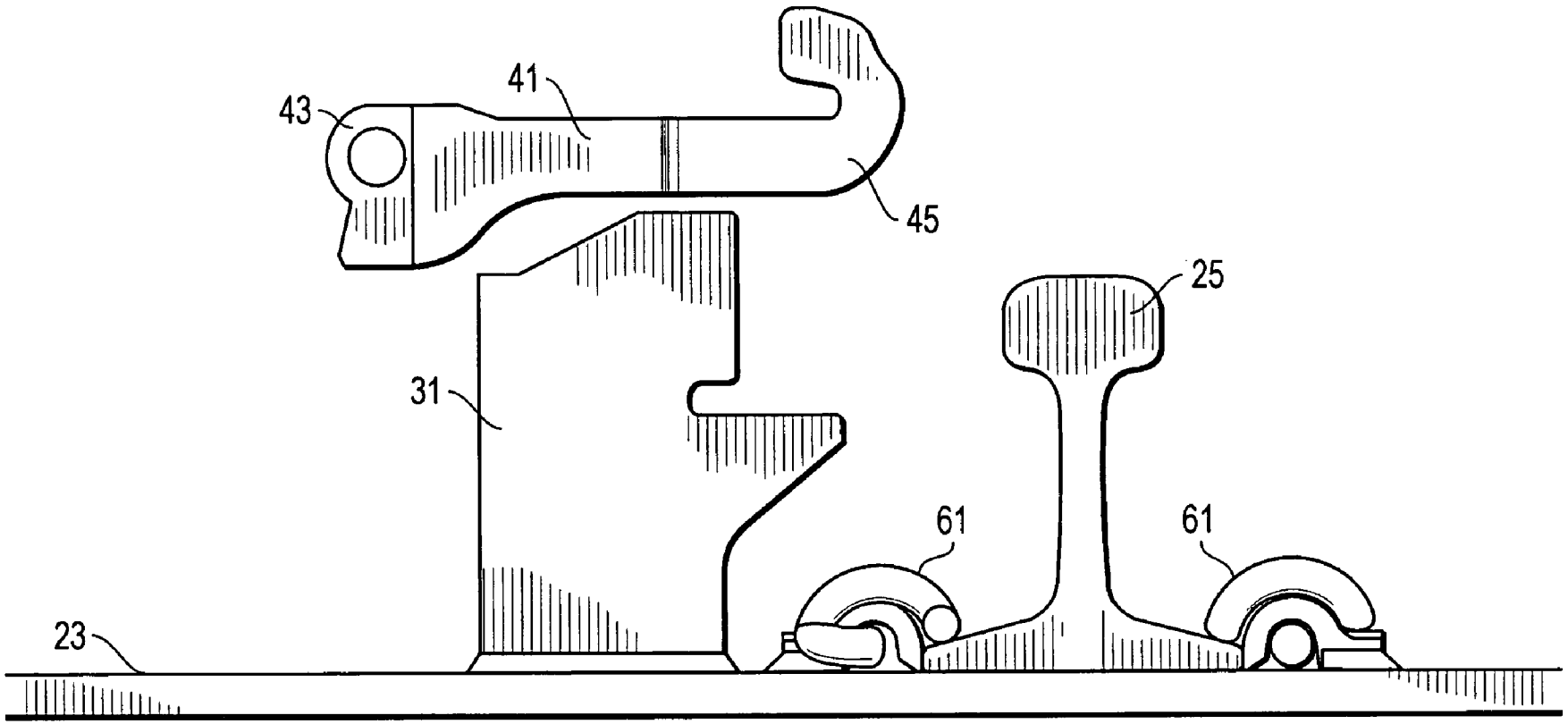
FIG. 3 is a side view of the assembly of FIG. 1 shown at an initial stage of assembly.
Figure 4:
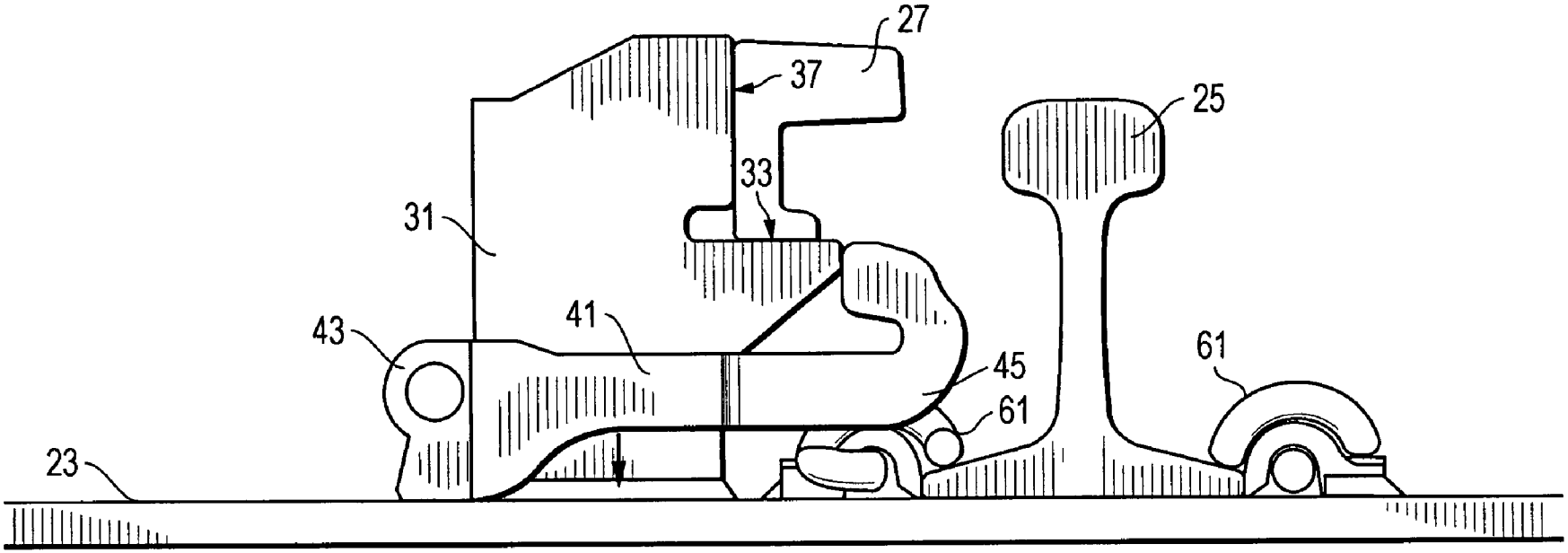
FIG. 4 is a side view of the assembly of FIG. 1 shown at a stage of assembly after FIG. 3.
Figure 5:
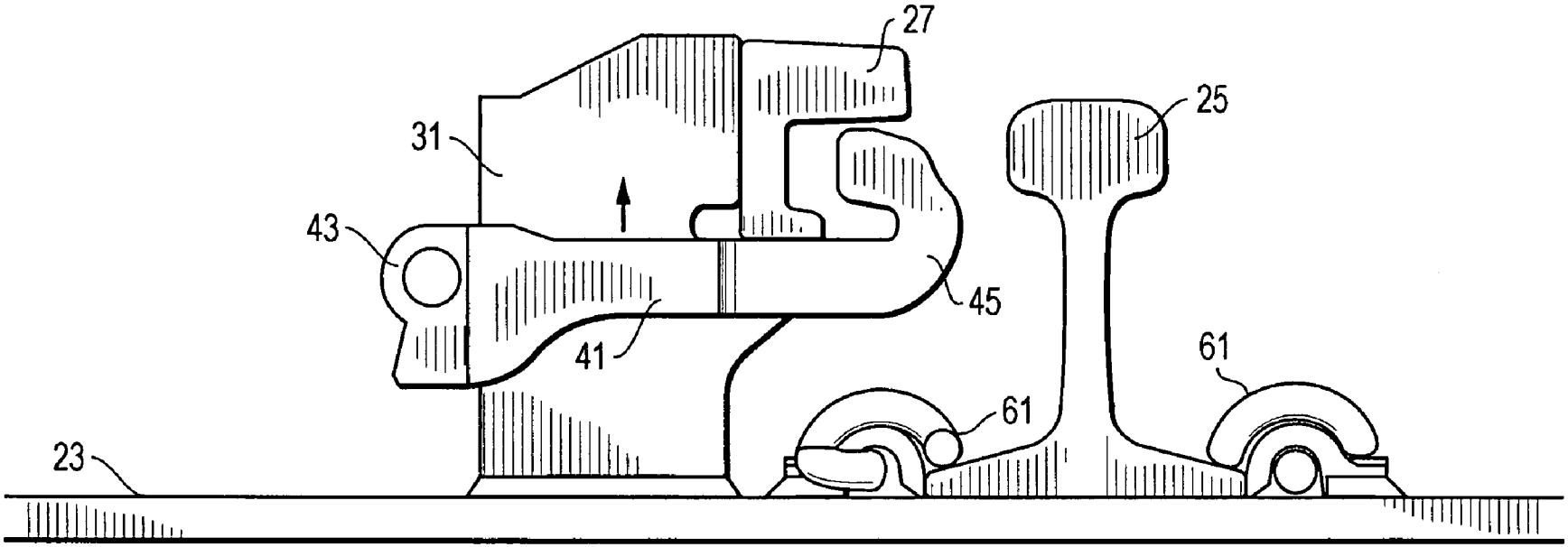
FIG. 5 is a side view of the assembly of FIG. 1 shown at a stage of assembly after FIG. 4.
Figure 6:
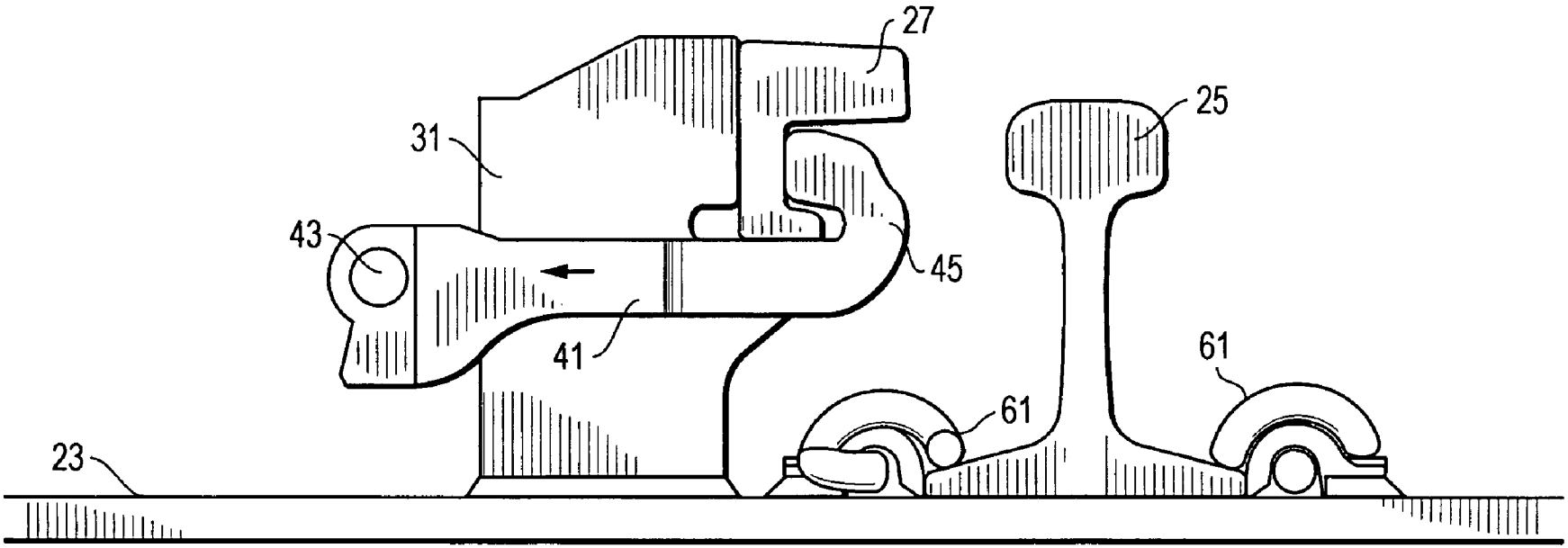
FIG. 6 is a side view of the assembly of FIG. 1 shown at a stage of assembly after FIG. 5.

Referring now to FIGS. 3-8, a sequence of steps that may be utilized to assemble the guide rail support assembly 21 are shown. In FIG. 3, the brace 31 is shown installed on plate 23 adjacent main rail 25. Hook device 41 is positioned above brace 31 with the two hooks 45 straddling the body of brace 31 therebelow. As shown in FIG. 4, hook device 41 is lowered straight down to plate 23, with hooks 45 now straddling brace 31 therebetween. Guide bar 27 is positioned on horizontal ledge 33 and against front vertical wall 37. In FIG. 5, hook device 41 is elevated such that it is close to or abuts the lower surface of guide bar 27 as shown, with hooks 45 out in front of guide bar 27. As shown in FIG. 6, hook device 41 is then moved rearward until hooks 45 seat in the pocket formed in guide bar 27. The hooks 45 continue to straddle brace 31. Finally (FIG. 7), the spacer block 51 and shims 53 are installed between the base 43 of hook device 41 and brace 31, before spring clip 61 is joined thereto to secure the entire assembly 21.

Figure 8:
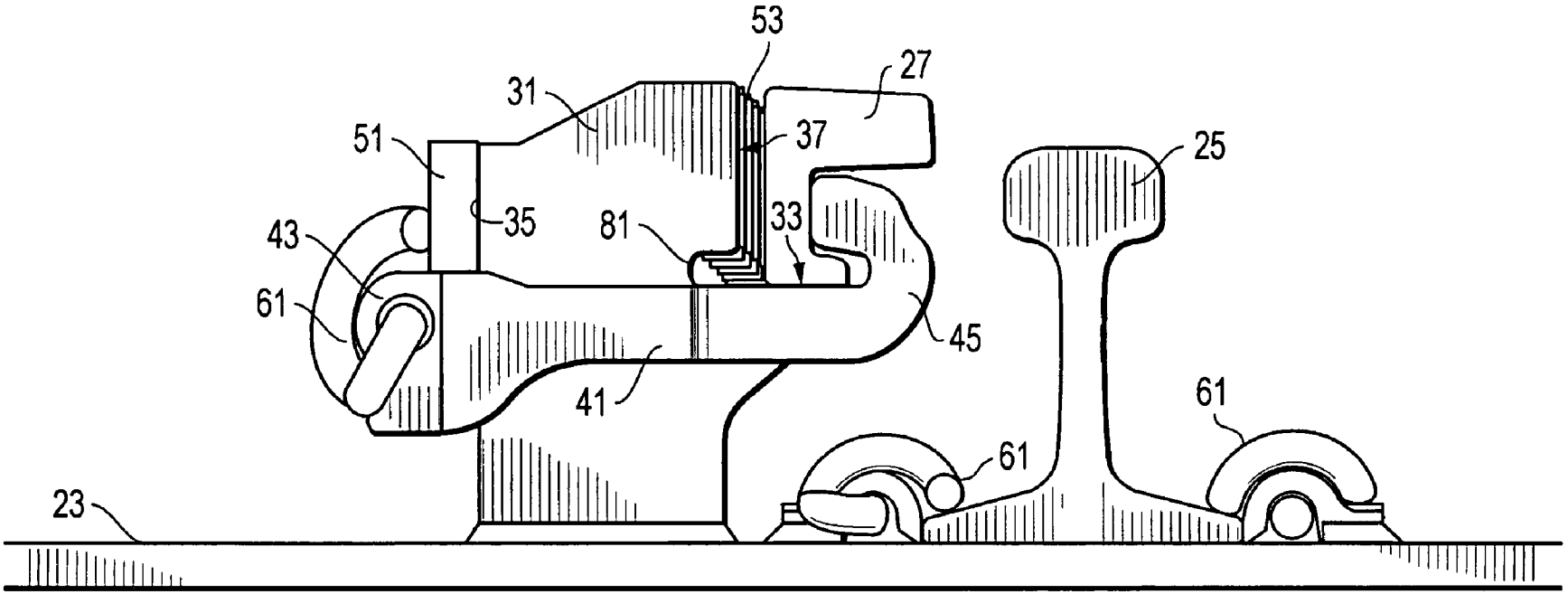
FIG. 8 is a side view of the assembly of FIG. 7 and illustrating a configuration for a worn guard bar.

Referring now to FIG. 8, the life of guide bar 27 may be extended after it is worn by relocating one or more of the shims 53 from rear surface 35 to front surface 37. Shims 53 are especially adapted to perform this function with their L-shaped bodies being located between brace 31 and guide bar 27. The L-shaped lip on shims 53 seats in a recess 81 located in brace 31 between surfaces 33 and 37. In this way, the wear surface of guide bar 27 is positioned laterally closer to main rail 25 and the train wheels that traverse it.

The present invention has several advantages, including the ability to provide higher frictional resistance to longitudinal movement of the guide rail relative to the brace compared to conventional single-hook designs. The configuration of the tubular base of the hook device allows spring clips to be inserted in a straighter direction and with greater ease, thereby reducing the chance that the clip will jump out when first being driven in and/or finally removed. In contrast, some single hook designs can cause the clip to hit an installer on the first strike when driving the clip in, or on the last strike when driving the clip out. With the single upright or brace welded to the plate, the open area around the brace is increased. This provides clearance for hold down spike holes on both sides of the brace, whereas single hook designs with two welded uprights or braces do not provide as much clearance.

While the invention has been shown or described in only some of its forms, it should be apparent to those skilled in the art that it is not so limited, but is susceptible to various changes without departing from the scope of the invention.

What is claimed is:

1. A guide rail support assembly, comprising:

a brace;

a guide rail positioned on the brace and extending in a longitudinal direction;

a hook device having a base and a plurality of hooks extending from the base around the brace and securing the guide rail to the brace;

adjustment shims positioned adjacent the brace; and a spring clip mounted adjacent the base and the adjustment shims for securing the hook device to the brace.

2. A guide rail support assembly according to claim 1, wherein the spring clip is a compression spring located directly between and in contact with the base of the hook device and the adjustment shims.

3. A guide rail support assembly according to claim 1, wherein the plurality of hooks comprises two hooks, one on each lateral side of the brace relative to the longitudinal direction.

4. A guide rail support assembly according to claim 1, wherein the brace has no apertures, and the plurality of hooks extend completely around the brace without penetrating any portion of the brace.

5. A guide rail support assembly according to claim 1, wherein the brace has a vertical rear wall opposite the guide rail with no horizontal ledge extending from the vertical rear wall, and an L-shaped lip on the adjustment shims seats in a recess located in the brace between a front vertical surface and a front horizontal ledge thereof.

6. A guide rail support assembly according to claim 1, wherein the hook device has a lateral length extending in a direction perpendicular to the longitudinal direction that exceeds a combined lateral length of the brace and the guide rail.

7. A guide rail support assembly according to claim 1, wherein the base of the hook device comprises a horizontal tubular base extending in the longitudinal direction for receiving an end of the spring clip, and the hook device, including the horizontal tubular base, has a longitudinal width that is greater than a longitudinal width of the brace.

8. A guide rail support assembly according to claim 7, wherein the longitudinal width of the brace is reduced such that the brace provides clearance for installation of at least two screw spikes in a plate underlying the brace.

9. A guide rail support assembly, comprising:

a plate;

a brace mounted to the plate and having a front ledge and a rear wall opposite the front ledge;

a guide rail positioned on the front ledge and having a longitudinal length that defines a longitudinal direction;

a hook device having a tubular base and a plurality of hooks extending from the tubular base around the brace and securing the guide rail to the brace;

a spacer block positioned between the tubular base and the brace;

adjustment shims positioned between the spacer block and the rear wall of the brace; and a spring clip mounted to the tubular base and engaging the spacer block for securing the hook device to the brace.

10. A guide rail support assembly according to claim 9, wherein the plurality of hooks comprises two hooks, one on each lateral side of the brace relative to the longitudinal direction.

11. A guide rail support assembly according to claim 9, wherein the brace has no apertures, and the plurality of hooks extend completely around the brace without penetrating any portion of the brace.

12. A guide rail support assembly according to claim 9, wherein the brace has a vertical rear wall opposite the guide rail with no horizontal ledge extending from the vertical rear wall, and an L-shaped lip on the adjustment shims seats in a recess located in the brace between a front vertical surface and a front horizontal ledge thereof.

13. A guide rail support assembly according to claim 9, wherein the hook device has a lateral length extending in a direction perpendicular to the longitudinal direction that exceeds a combined lateral length of the brace and the guide rail.

14. A guide rail support assembly according to claim 9, wherein:

the base of the hook device comprises a horizontal tubular base extending in the longitudinal direction for receiving an end of the spring clip, and the hook device, including the horizontal tubular base, has a longitudinal width that is greater than a longitudinal width of the brace; and the longitudinal width of the brace is reduced such that the brace provides clearance for installation of at least two screw spikes in a plate underlying the brace.

15. A railroad section, comprising:

a plurality of plates;

a pair or rails mounted to the plates;

a guide rail support assembly mounted to the plates adjacent at least one of the rails; the guide rail support assembly comprising:

a plurality of braces, each of which is mounted to one of the plates and each having a horizontal front ledge and a vertical rear wall opposite the front ledge;

a guide rail positioned on the front ledges of the braces, the guide rail having a longitudinal length that defines a longitudinal direction;

a plurality of hook devices, each having a tubular base and a pair of hooks extending from the tubular base completely around sides of the brace without penetrating the brace and securing the guide rail to the braces;

a plurality of spacer blocks, each positioned between a respective one of the tubular bases and the braces;

adjustment shims positioned between respective ones of the spacer blocks and the rear walls of the braces; and a plurality of spring clips, each mounted to a respective one of the tubular bases and engaging a respective one of the spacer blocks for securing the hook devices to the braces.

16. A railroad section according to claim 15, wherein each of the braces has a vertical rear wall opposite the guide rail with no horizontal ledge extending from the vertical rear wall, and an L-shaped lip on the adjustment shims seats in a recess located in the brace between a front vertical surface and a front horizontal ledge thereof.

17. A railroad section according to claim 15, wherein each of the hook devices has a lateral length extending in a direction perpendicular to the longitudinal direction that exceeds a combined lateral length of a respective one of the braces and the guide rail.

18. A railroad section according to claim 15, wherein:

the base of each of the hook devices comprises a horizontal tubular base extending in the longitudinal direction for receiving an end of a respective one of the spring clips, and the hook device, including the horizontal tubular base, has a longitudinal width that is greater than a longitudinal width of a respective one of the braces; and the longitudinal width of one of the braces is reduced such that the brace provides clearance for installation of at least two screw spikes in a plate underlying the brace.

* * * * *